United States Patent [19]

Jorgensen

[11] 4,272,921

[45] Jun. 16, 1981

[54] TRAFFIC RESPONSIVE CONTROL SYSTEM FOR AUTOMATICALLY OPERATED DOORS

[75] Inventor: Robert Jorgensen, Niles, Mich.

[73] Assignee: Kawneer Company, Inc., Niles, Mich.

[21] Appl. No.: 971,781

[22] Filed: Dec. 21, 1978

[51] Int. Cl.[3] ..... E05F 15/20

[52] U.S. Cl. ..... 49/30; 49/31; 49/25

[58] Field of Search ..... 49/25, 30, 31, 264; 340/527

[56] References Cited

U.S. PATENT DOCUMENTS

| | | | |
|---|---|---|---|
| 3,147,000 | 9/1964 | Pinckaers | 49/264 X |
| 3,742,434 | 6/1973 | Leyde et al. | 49/25 |

*Primary Examiner*—Kenneth Downey

*Attorney, Agent, or Firm*—Mason, Kolehmainen, Rathburn & Wyss

[57] ABSTRACT

A traffic responsive control system for controlling one-way traffic through a door in which the door opening means is disabled when power is initially applied to the control system while permitting the door opening means to respond to a door opening signal on the traffic side of the door immediately after termination of a safety signal on the safety side of the door.

10 Claims, 3 Drawing Figures

34
36
38
40
Q6
32
C
A
B
44
42
46
30
Q2
Q3
56
54
50
48
28
26
52
14
16
20
Q1
18
22
24
12
10
SAFETY SIGNAL
OPERATE SIGNAL

42
B
44
64
60
46
Q2
56
62
A
54
28
26
52
Q1
12
SAFETY SIGNAL
C

TRAFFIC
53
51
57
55

TRAFFIC RESPONSIVE CONTROL SYSTEM FOR AUTOMATICALLY OPERATED DOORS

The present invention relates to a control system for controlling automatically operated doors, and more particularly, to a traffic responsive control system for controlling one-way traffic through a door which is responsive to the presence of traffic on both the operate and safety sides of the door.

Various arrangements have been heretofore proposed for controlling the traffic through an automatically operated door. One such arrangement provides that any detection of traffic by the sensor on the safety side of the door, which sensor is normally a switch mat, will initiate a one to two-second time delay which must expire before the door operator will respond to the detection of traffic by the sensor on the active side of the door. While a control system of this type is satisfactory for its intended purpose when switch mats are employed as the sensors on both the operate and safety sides of the door, it has been found that when an optical sensing arrangement such as shown for example in Kahl, et al. application Ser. No. 661,093, filed Feb. 27, 1976 is employed, an unsatisfactory type of operation results. These unsatisfactory results occur in entrances fitted with transparent doors wherein the metal stile on the door lock side of the door is detected by the short-range beams of the safety sensor which cover the areas swept by the door as it is closing. Each time the door lock stile is detected by a beam lobe of the safety sensor the time delay is re-initiated and since the beam lobes extend quite close to the door closed position the use of such an optical sensor requires that the door becomes completely closed and then await the expiration of the last time delay before the door can again open.

It is, therefore, a primary object of the present invention to provide a new and improved traffic responsive control system which may be used with optical beam sensing arrangements on both the safety and operate sides of the door without introducing an undesired time delay after the sensor on the safety side of the door is actuated.

It is another object of the present invention to provide a new and improved traffic responsive control system which prevents the door opening means on the operate side of the door from opening the door when power is initially applied to the control system while permitting the door opening means to open the door immediately after a sensor signal on the safety side of the door is terminated.

It is a further object of the present invention to provide a new and improved traffic responsive control system wherein the door operating means is not actuated in response to the application of power to the control system, and in addition is not actuated in the event that power is removed from the control system and then immediately re-applied.

The invention both as to its organization and method of operation, together with further objects and advantages thereof, will best be understood by reference to the following specification taken in connection with the accompanying drawings.

Figure 1:
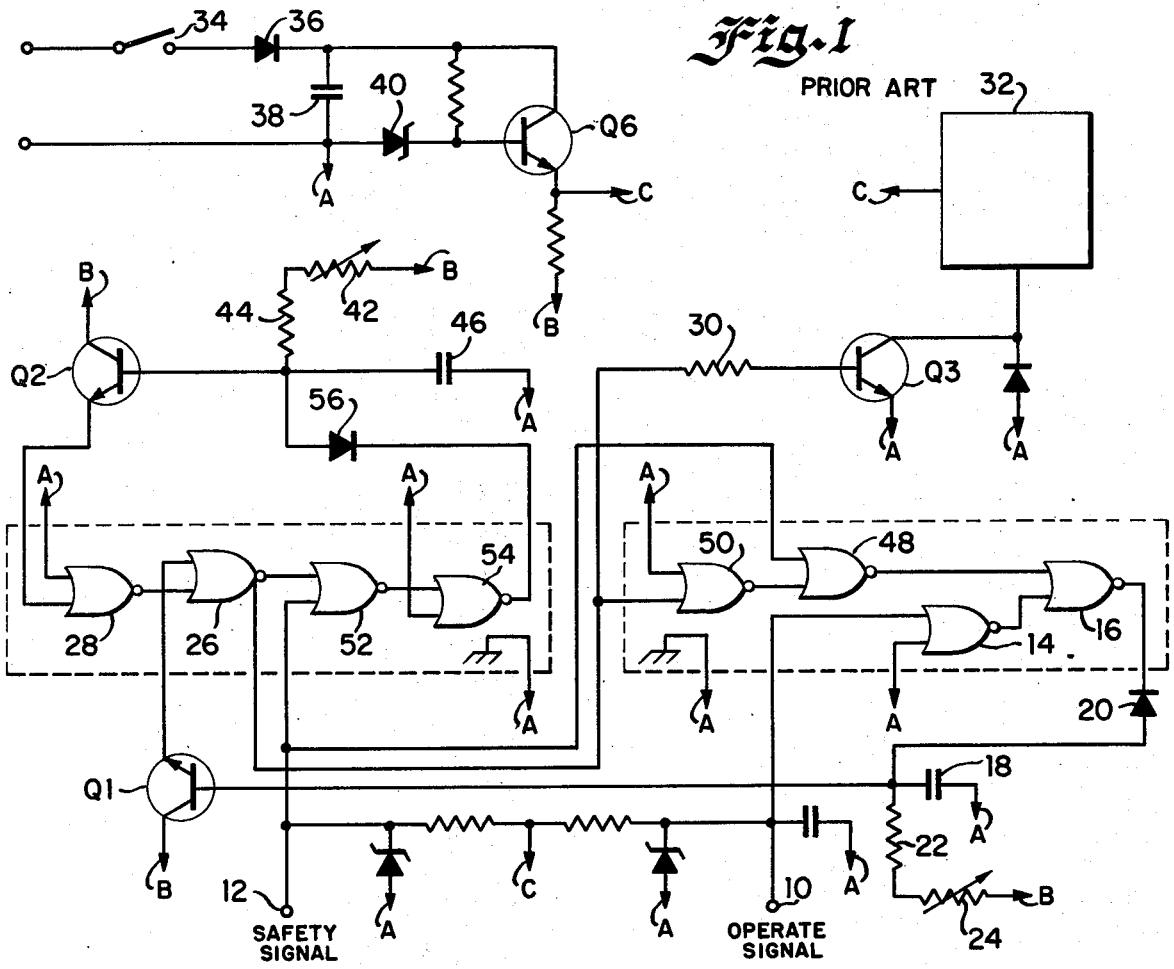
Fig. 1 PRIOR ART
FIG. 1 is a circuit diagram of the logic portion of a prior art traffic responsive control system.

Referring now to the drawings and more particularly to FIG. 1 thereof, the logic portion of the control system shown in FIG. 1 is arranged to operate in response to either an operate signal at the terminal 10, when traffic on the operate side of the door is detected, or a safety signal on the terminal 12 when traffic is detected on the safety side of the door. Considering first the normal operation of the system, when an operate signal is applied to terminal 10 the voltage at this terminal goes from a "1" to a "0", this signal being applied to one input of a NOR-gate 14 the other input of which is connected to logic ground. Accordingly, a "1" signal is developed in the output of the NOR-gate 14 which is supplied as one input to the NOR-gate 16. Under normal operating conditions the other input of the NOR-gate 16 is "0". Accordingly, when the output of the NOR-gate 14 changes from "0" to "1" the output of the NOR-gate 16 goes from "1" to "0" so that the capacitor 18, which is connected to the base of the transistor "Q1", is rapidly discharged through the diode 20, the capacitor 18 being initially charged from the 3.6 volt supply through a resistor 22 and a potentiometer 24. The emitter of the transistor Q1 is connected to one input of a NOR-gate 26, the other input of the NOR-gate 26 being supplied from the output of a NOR-gate 28. Under normal operation the output of the NOR-gate 28 is "0", as will be described in more detail hereinafter. Accordingly, when the transistor Q1 is rendered non-conductive upon discharge of the capacitor 18, the output of the NOR-gate 26 goes positive and supplies an operate signal through a resistor 30 to the base of a transistor Q3 so that this transistor is rendered conductive. When the transistor Q3 conducts the door opening means 32 connected in the collector circuit of the transistor Q3 is actuated and the door is automatically opened. In this connecton it will be understood that any suitable control circuit may be provided which is responsive to the flow of current through the collector of the transistor Q3, insofar as the present invention is concerned. Conventionally, the transistor Q3 is employed to control a gate pulse generating circuit the gate pulses of which in turn control a triac control circuit which is of sufficient power to control a door operating motor so that the door is opened. Also, it is conventional to compress a spring as the door is opened so that when the door opening motor is de-energized the door is automatically closed by the energy stored in the compressed spring.

Considering now the manner in which the NOR-gate 28 is controlled, when power is applied to the control system as for example through the ON-OFF switch 34, the 60 Hz power is rectified in the rectifier 36 and the rectified voltage across the capacitor 38 is applied to a series regulating transistor Q6 so that a regulated plus 6.8 volts is developed at the terminal "C" and a regulated plus 3.6 volts is developed at the terminal "B", the Zener diode 40 acting as the stable reference potential for the regulating transistor Q6.

This 3.6-volt potential is applied through the potentiometer 42 and a resistor 44 to a timing capacitor 46 so that this capacitor is charged at a predetermined rate when the ON-OFF switch 34 is closed. At the same time the capacitor 18 is charged positive through the potentiometer 24 and resistor 22. However, the charging rate of the capacitor 18 is somewhat faster than the charging rate of the capacitor 46, so that the transistor Q1 is rendered conductive before the capacitor 46 has been charged to a sufficiently positive potential to cause conduction of the transistor Q2 the base of which is connected to the capacitor 46. When the transistor Q1 is initially rendered conductive in response to closure of the ON-OFF switch 34, the transistor Q2 is thus still non-conductive so that the output of the NOR-gate is a "1". Accordingly, when the transistor Q1 is initially rendered conductive in response to charging of the capacitor 18 when power is applied to the control system, the door opening means 32 is not actuated so that the door is not falsely opening in response to closure of the switch 34. As soon as the capacitor 46 has been charged to a level at which the transistor Q2 conducts the output of the NOR-gate becomes a "0" and a traffic generated operate signal on the terminal 10 will thereafter control the door opening means 32 to open the door, as described in detail heretofore.

As the person who has actuated the operate signal 10 moves through the opened door the capacitor 18 introduces a time delay as it is charged through the resistor 22 and the potentiometer 24 so that the door is not immediately closed as the person passes through the opened door. Also, when the person passing through the door activates the safety sensor so that a safety signal is developed on the terminal 12 the door is held open until he moves out of the range of the safety sensor.

More particularly, when the safety signal is applied to the terminal 12 one input of a NOR-gate 48 changes from a "1" to a "0". The other input of the NOR-gate 48 is supplied from the output of a NOR-gate 50 one input of which is connected to logic ground and the other input of which is connected to the door opening signal supplied to the resistor 30. Accordingly, when the door is opened the output of the NOR-gate 50 is a "0" so that the safety signal applied to the NOR-gate 48 while the door is open reverses the output of the NOR-gate 48 from a "0" to a "1". This causes the output of the NOR-gate 16 to change from a "1" to a "0" so that the capacitor 18 continues to be discharged, through the diode 20 and the door remains open.

When a safety signal is generated during a period when the door is not open, which indicates the presence of a person on the safety side of the door, a one to two-second time delay is initiated to prevent the door from being opened in response to an operate signal on the terminal 10 while a person is in the safety zone on the opposite side of the door. More particularly, when the door is not open the output of the NOR-gate 26 is a "0" and hence when a safety signal appears on the terminal 12 both inputs of a NOR-gate 52 are "0" and hence the output of the NOR-gate 52 changes to a "1". This output is supplied to a NOR-gate 54 the other input of which is connected to logic ground. Accordingly, when a safety signal appears on the terminal 12 the output of the NOR-gate 54 changes from a "1" to a "0" so that the capacitor 46 is discharged through a diode 56. When the capacitor 46 discharges the transistor Q2 is rendered non-conductive and prevents a door opening signal from being developed in the output of the NOR-gate 26 even though the transistor Q1 is thereafter rendered non-conductive in response to an operate signal on the terminal 10. This condition continues until the person on the safety side of the door moves out of the range of the safety sensor and the capacitor 46 charges to a level sufficient to cause the transistor Q2 to again conduct.

Figure 3:
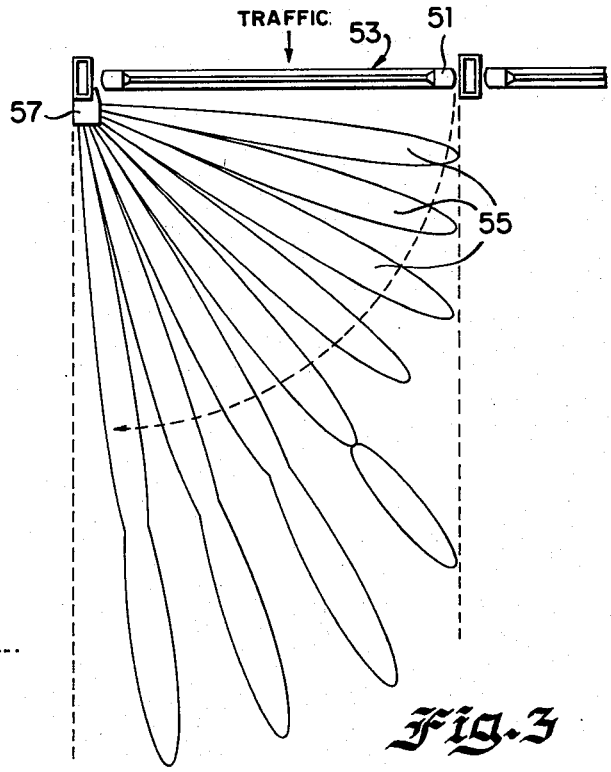
FIG. 3 is a diagrammatic illustration of an optical sensing system in which the control system of the present invention may be employed.

While the arrangement described thus far is satisfactory for its intended purpose, it has been found that when an optical sensing arrangement, such as optical sensor 57 shown in FIG. 3, is employed on the safety side of the door a safety signal is produced due to reflection from the conductive door lock stile 51 of the door 53 which occurs as the door is closing even though no person is present in the safety area on the safety side of the door. More particularly, each time the stile 51 forces through one of the detection lobes 55 of the optical sensor 57 a safety signal is developed at the terminal 12. Since the detection lobes 55 of the sensor 57 usually extend close to the closed position of the door, the capacitor 46 is continually discharged by the safety signals applied to the terminal 12 under these conditions. Accordingly, each time the door 53 is closed a one to two-second time delay is experienced which prevents the door from again being opened until the capacitor 46 has been re-charged.

In accordance with the present invention, the undesired time delay is eliminated while maintaining the above-described desirable time delay in enabling the operate circuit so that the door will not be opened when power is applied to the control system. More particularly, in the circuit arrangement of the present invention shown in FIG. 2 a resistor 60 which may have a value of 22,000 ohms is connected between the base of the transistor Q2 and the capacitor 46. Also, the diode 56 is connected directly to the base of the transistor Q2 so that when the diode 56 is rendered conductive by the appearance of a "0" signal in the output of the NOR-gate 54, the capacitor 46 is discharged down only to a predetermined level as determined by the values of the resistor 60, the resistor 44 and the potentiometer 42. This predetermined level is sufficient to cause the transistor Q2 to conduct immediately after the diode 56 is again rendered non-conductive by the disappearance of a safety signal on the terminal 12. Accordingly, the time delay which is present in the circuit of FIG. 1 after the safety signal disappears from the terminal 12 while the capacitor 46 is being charged, is eliminated in the circuit arrangement of FIG. 2. However, the desirable feature of holding the transistor Q2 non-conductive when the ON-OFF switch 34 is first closed and power is applied to the control system is retained in the circuit arrangement of the present invention. This is because the capacitor 46 is discharged completely when power is turned off of the control system and this capacitor must charge to the above-described predetermined level when power is initially applied before the transistor Q2 will conduct. Accordingly, initial opening of the door when power is applied to the control system is avoided in a manner described in detail heretofore in connection with FIG. 1. If desired, a capacitor 62 may be connected from the base of the transistor Q2 to logic ground which will provide additional filtering at the base of the transistor Q2 to prevent the control system from responding to false signals which may be present on the incoming power line. However, the capacitor 62 may be eliminated if additional filtering or regulation is provided in the main power supply which provides the plus 3.6 and plus 6.8-volt potentials. Also, the capacitor 62 must be of small enough value that it does not itself introduce an additional time delay.

Figure 2:
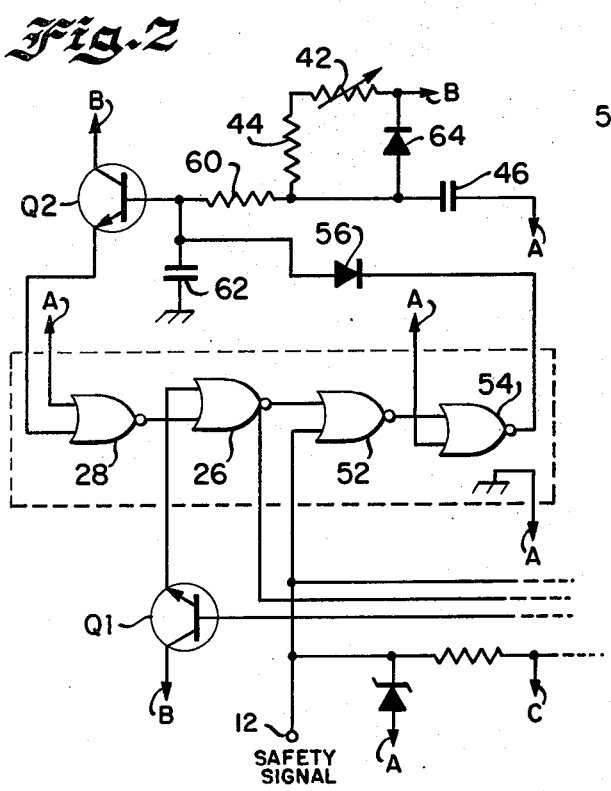
FIG. 2 is a circuit diagram of a portion of the circuit of FIG. 1 as modified in accordance with the present invention.

In the circuit arrangement of FIG. 2, when power is removed from the control system and is then immediately reapplied, as for exaple when the ON-OFF switch 34 is opened and then substantially immediately closed again, the door may be opened. This undesired opening of the door is caused because the capacitor 18 will discharge more quickly than the capacitor 46 because the capacitor 46 has to discharge through the resistor 60. As soon as the capacitor 18 is discharged sufficiently to cause the transistor Q1 to become non-conductive a door opening signal will be provided to the transistor Q3 if the capacitor 46 is still charged sufficiently to maintain the transistor Q2 conductive. In accordance with a further aspect of the present invention, this undesirable operation is avoided by providing a diode 64 (FIG. 2) across the resistor 44 and the potentiometer 42. This diode is polarized so that it does not conduct during periods when a plus 3.6 volt signal is supplied from the power supply. However, as soon as the ON-OFF switch 34 is opened and the power supply voltage goes to zero, the diode 64 conducts and immediately discharges the capacitor 46. As a result, the transistor Q2 is substantially immediately rendered non-conductive so that the door is prevented from opening as the capacitor 18 discharges to zero at its normal rate.

While there has been illustrated and described an embodiment of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A traffic responsive control system arranged to control traffic through a door and responsive to the presence of traffic on both the operate and safety sides of the door, comprising means for developing a first control signal in response to the presence of traffic in a predetermined area on the operate side of the door, means for developing a second control signal in response to the presence of traffic in a predetermined area on the safety side of the door, a power switch, means controlled by said power switch for developing power for said control system, means responsive to said first control signal for opening said door, said door opening means also operating in response to the application of power of said control system when said power switch is closed, means for disabling said door opening means when power is initially applied to said control system, thereby to prevent opening of said door in response to closure of said power switch, and means for preventing said disabling means from also responding to said second control signal so that said door can be opened in response to said first control signal substantially immediately after termination of said second control signal.

2. A traffic responsive control system arranged to control traffic through a door and responsive to the presence of traffic on both the operate and safety sides of the door, comprising means for developing a first control signal in response to the presence of traffic in a predetermined area of the operate side of the door, means for developing a second control signal in response to the presence of traffic in a predetermined area on the safety side of the door, said last named means also developing at least one false second control signal due to reflection from the stile of the door as the door closes, a power switch, means controlled by said power switch for developing power for said control system, means responsive to said first control signal for opening said door, said door opening means also operating in response to the application of power to said control system when said power switch is closed, means for disabling said door opening means when power is initially applied to said control system, thereby to prevent opening of said door in response to closure of said power switch, and means for preventing said disabling means from also responding to said false second control signal so that said door can be opened in response to said first control signal substantially immediately after termination of said false second control signal.

3. The traffic responsive control system of claim 2, wherein said disabling means includes a timing capacitor, means for charging said capacitor at a predetermined rate in response to the application of a power to said control system when said power switch is closed, and means for disabling said door opening means until said timing capacitor has been charged to a predetermined level.

4. A traffic responsive control system arranged to control traffic through a door and responsive to the presence of traffic on both the operate and safety sides of the door, comprising means for developing a first control signal in response to the presence of traffic in a predetermined area on the operate side of the door, means for developing a second control signal in response to the presence of traffic in a predetermined area on the safety side of the door, first and second timing capacitors, first and second charging circuits for said first and second capacitors, means for connecting said source of potential to said first and second charging circuits, said first capacitor being charged at a slower rate than said second capacitor in response thereto, means controlled by said first control signal and operative when said second capacitor is not charged to a predetermined level for opening said door, means for disabling said door opening means until said first capacitor has been charged to a predetermined level so that said door opening means is not actuated in response to connection of said source to said charging circuits, and means for quickly discharging said first capacitor when said source of potential is removed from said first and second charging circuits, thereby to prepare said first capacitor for recharging at said slower rate in the event said source of potential is immediately re-applied to said first and second charging circuits.

5. The traffic responsive control system of claim 4, wherein said first charging circuit includes a resistor connected between said source of potential and said first timing capacitor, and said discharging means comprises a diode connected across said resistor and polarized so that said capacitor quickly discharges through said diode when said source of potential is turned off.

6. A traffic responsive control system arranged to control traffic through a door and responsive to the presence of traffice on both the operate and safety sides of the door, comprising means for developing a first control signal in response to the presence of traffic in a predetermined area on the operate side of the door, means for developing a second control signal in response to the presence of traffic in a predetermined area on the safety side of the door, door opening means including a normally charged timing capacitor, means responsive to said first control signal for discharging said timing capacitor, and means responsive to discharge of said capacitor for opening said door, said timing capacitor being also discharged for a predetermind time interval after the application of power to said control system, means for disabling said door opening means when power is initially applied to said control system, said disabling means being operative for a time interval longer than said predetermined time interval, thereby to prevent opening of said door in response to said application of power, and means for preventing said disabling means from also responding to said second control signal so that said door can be opened in response to said first control signal substantially immediately after termination of said second control signal.

7. A traffic responsive control system arranged to control traffic through a door and responsive the presence of traffic on both the operate and safety sides of the door, comprising means for developing a first control signal in response to the presence of traffic in a predetermined area on the operate side of the door, means for developing a second control signal in response to the presence of traffic in a predetermined area on the safety side of the door, said last named means also developing at least one false second control signal due to reflection from the stile of the door as the door closes, means responsive to said first control signal for opening said door, said door opening means also operating in response to the application of power to said control system, means for disabling said door opening means when power is initially applied to said control system, thereby to prevent opening of said door in response to said application of power, said disabling means including a timing capacitor, a control transistor, means connecting said timing capacitor to the base of said control transistor, means normally operative to charge said timing capacitor to a potential sufficient to cause conduction of said control transistor, means responsive to conduction of said control transistor for enabling said door opening means, and means responsive to either said second control signal or said false second control signal for rendering said control transistor nonconductive while maintaining said capacitor sufficiently charged to cause substantially immediate conduction of said control transistor upon termination of either said second control signal or said false second control signal.

8. A traffic responsive control system arranged to control traffic through a door and responsive to the presence of traffic on both the operate and safety sides of the door, comprising means for developing a first control signal in response to the presence of traffic in a predetermined area on the operate side of the door, means for developing a second control signal in response to the presence of traffic in a predetermined area on the safety side of the door, said last named means also developing at least one false second control signal due to reflection from the stile of the door as the door closes, means responsive to said first control signal for opening said door, said door opening means also operating in response to the application of power to said control system, means for disabling said door opening means when power is initially applied to said control system, thereby to prevent opening of said door in response to said application of power, said disabling means including a timing capacitor, a control transistor, means for charging said capacitor at a predetermined rate in response to the application of power to said control system, a resistor connected between said timing capacitor and the base of said control transistor, means responsive to conduction of said control transistor when said capacitor has been charged to a predetermined level for enabling said door opening means, and means responsive to either said second control signal or said false control signal for rendering said control transistor nonconductive while maintaining said capacitor charged to said predetermined level, whereby said control transistor is again rendered conductive substantially immediately upon termination of either said second control signal or said false second control signal.

9. The traffic control system of claim 8, wherein said means for rendering said control transistor nonconductive includes a diode connected to the junction of said resistor and the base of said transistor, and means for applying a disabling voltage to said diode corresponding to either said second control signal or said false second control signal, said resistor having a value such that said capacitor remains charged to said predetermined level while said transistor is nonconductive.

10. The traffic control system of claim 9, which includes a source of unidirectional potential, a second resistor connected between said source and said capacitor for charging said capacitor at said predetermined rate, and a diode connected across said resistor and polarized so that said capacitor quickly discharges through said diode when said source of unidirection potential is turned off.

* * * * *